US006515431B2

(12) United States Patent
Moo et al.

(10) Patent No.: US 6,515,431 B2
(45) Date of Patent: Feb. 4, 2003

(54) MULTI-LAMP PROTECTION CIRCUIT FOR AN ELECTRONIC BALLAST

(75) Inventors: Chin-Sien Moo, Kaohsiung Hsien (TW); Tsai-Fu Lin, Pingtung (TW)

(73) Assignee: Yin Nan Enterprises Co., Ltd., Kaohsiung Hsien (TW)

( * ) Notice: Subject to any disclaimer, the term of this patent is extended or adjusted under 35 U.S.C. 154(b) by 15 days.

(21) Appl. No.: 09/775,559

(22) Filed: Feb. 5, 2001

(65) Prior Publication Data

US 2002/0105291 A1 Aug. 8, 2002

(51) Int. Cl.[7] ..... H05B 41/36

(52) U.S. Cl. ..... 315/224

(58) Field of Search ..... 315/150, 151, 315/200, 224, 225, 283, 291, 307; 361/18, 20, 78, 87, 93, 65

(56) References Cited

U.S. PATENT DOCUMENTS

| | | | | | |
|---|---|---|---|---|---|
| 5,825,137 | A | * | 10/1998 | Titus | 315/291 |
| 5,869,935 | A | * | 2/1999 | Sodhi | 315/225 |
| 6,051,938 | A | * | 4/2000 | Arts et al. | 315/291 |
| 6,111,368 | A | * | 8/2000 | Luchaco | 315/307 |
| 6,181,076 | B1 | * | 1/2001 | Trestman et al. | 315/224 |
| 6,316,883 | B1 | * | 11/2001 | Cho et al. | 315/247 |

* cited by examiner

*Primary Examiner*—Don Wong
*Assistant Examiner*—Minh D A

(57) ABSTRACT

A multi-lamp protection circuit for an electronic ballast includes an inverter circuit of various types, and a transistor switch provided in the inverter circuit and connected to a plurality of lamp circuits, each lamp circuit connected respectively in series to a transistor switch and a disorder checking circuit. The signal got by the disorder checking circuits mixed with a control signal starts resonance transistors so as to checking disorder and separating the damaged lamp(s), lessening its producing cost and achieving normal efficiency of the lamps.

13 Claims, 3 Drawing Sheets

MULTI-LAMP PROTECTION CIRCUIT FOR AN ELECTRONIC BALLAST

BACKGROUND OF THE INVENTION

1. Field of the Invention

This invention relates to a multi-lamp protection circuit for an electronic ballast. The multi-lamp protection circuit, which is realized with solid-state devices and hence can be of low cost and small size, is particularly used to isolate the abnormal lamp(s) from the normal lamp(s).

2. Description of the Prior Art

Electronic ballasts have gradually taken place of traditional heavy electromagnetic ballasts to drive fluorescent lamps because of their light, small size and better performances. In order to reduce the product cost, the electronic ballast is designed to drive multi-lamps when two or more lamps are installed in a same fixture.

At present, an electronic ballast mainly uses a half-bridge series-resonant-inverter to drive the fluorescent lamps at a high frequency. For such an electronic circuit, an excessive large current may flow through power devices of the inverter and the filament of the lamp, in case that the lamp fails to be started up or comes to its life end. Therefore, difficulties surely arise from how to get rid of abnormal lamps and how to maintain normal operation of lamps when a plurality of lamps are driven by a ballast. The present method of an electronic ballast with a lamp protection circuit is to use a common electronic ballast for a plurality of lamps for separating a damaged lamp with a relay. But using a relay with mechanical contacts not merely reduces reliability but has disadvantage of a large dimension, a loud noise, and low efficiency, forming an adverse consequence against demand for light small electronic ballasts.

SUMMARY OF THE INVENTION

The objective of the invention is to offer a multi-lamp protection circuit for an electronic ballast, which can be manufactured with less cost than the conventional ones, and possible to cut off the abnormal lamp(s) instantly to protect the ballast. As a result, the normal lamp(s) can be operated normally free from the outage disturbance.

The discriminate feature of the invention is that all lamp circuits are parallel-connected and energized by an inverter circuit, lamp current of every lamp is detected and referred to its abnormality-detect circuit, respectively. The control signal of each switch is AND gated by the output of each abnormality-detect circuit. Therefore, the inverter operation of the malfunctioning lamp may be suppressed by the abnormality-detect circuit output, while the other lamps will keep on operating normally. Thus, the multi-lamp ballast protection can be achieved at a reduced cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
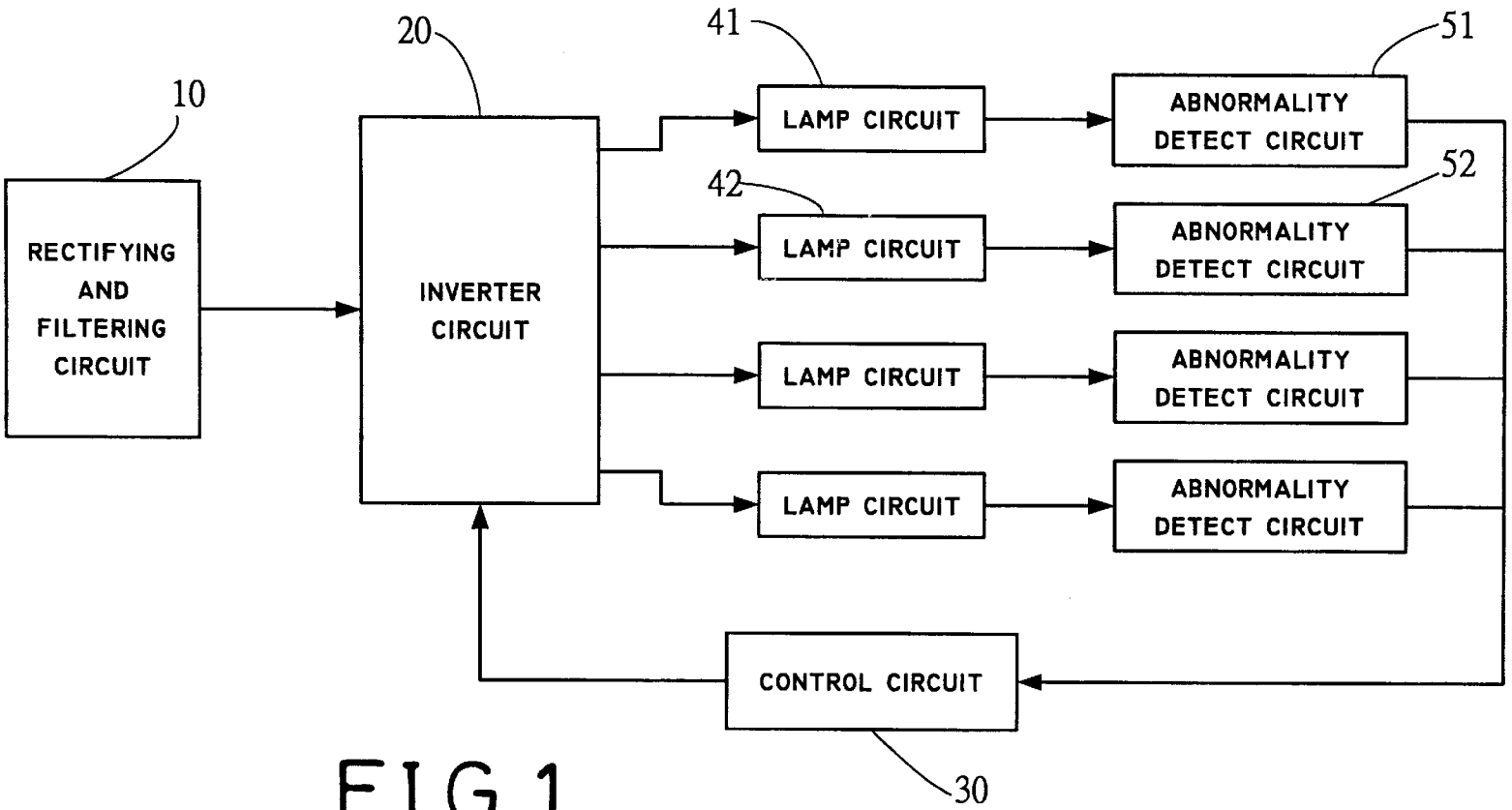
FIG. 1 is a block diagram of a mult-lamp protection circuit for an electronic ballast in the present invention.
Figure 2:
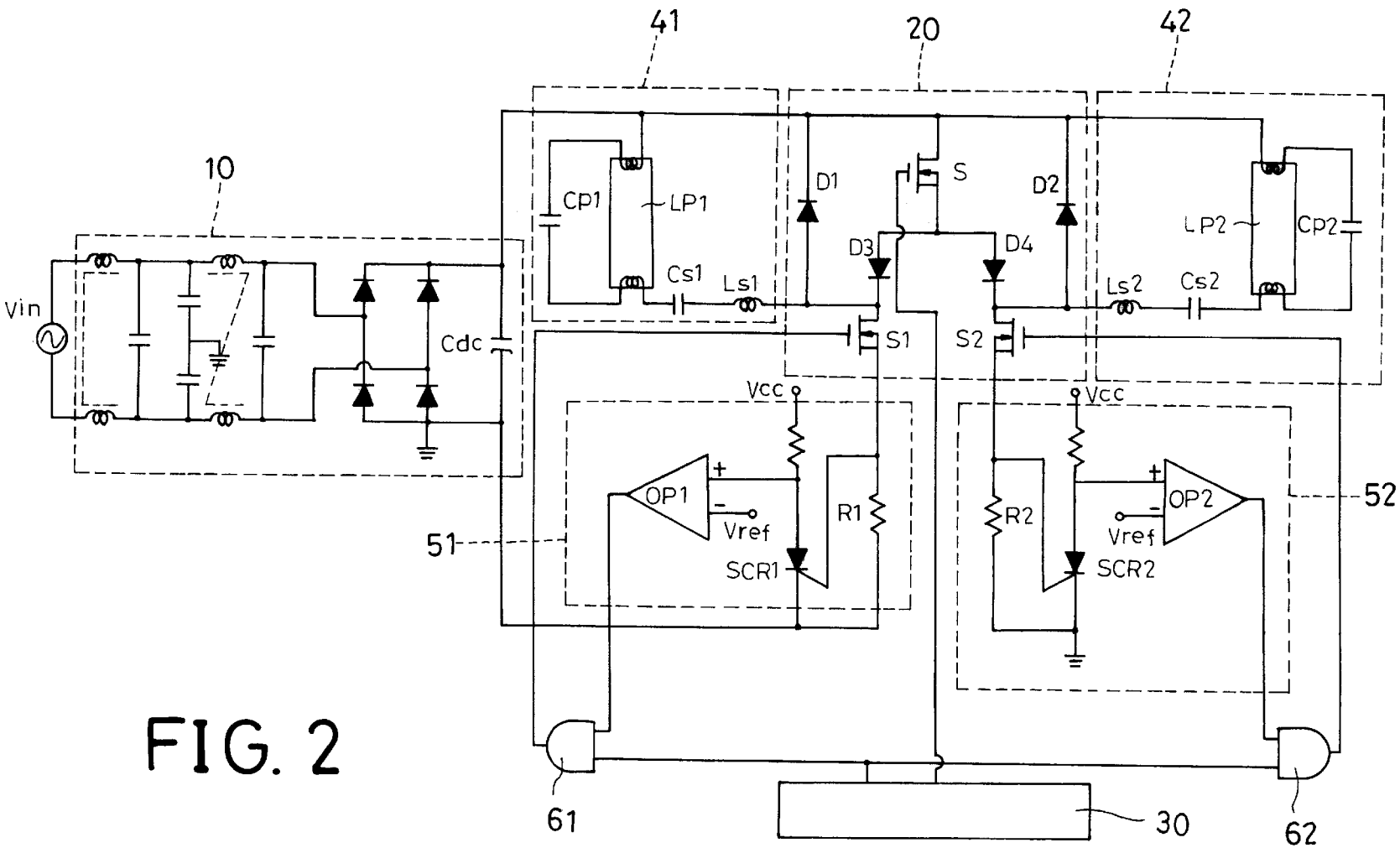
FIG. 2 is a diagram of the mult-lamp protection circuit for an electronic ballast in the present invention; and, FIG. 3 is a diagram of the voltage of lamps and transistor switches in the present invention.
Figure 3:
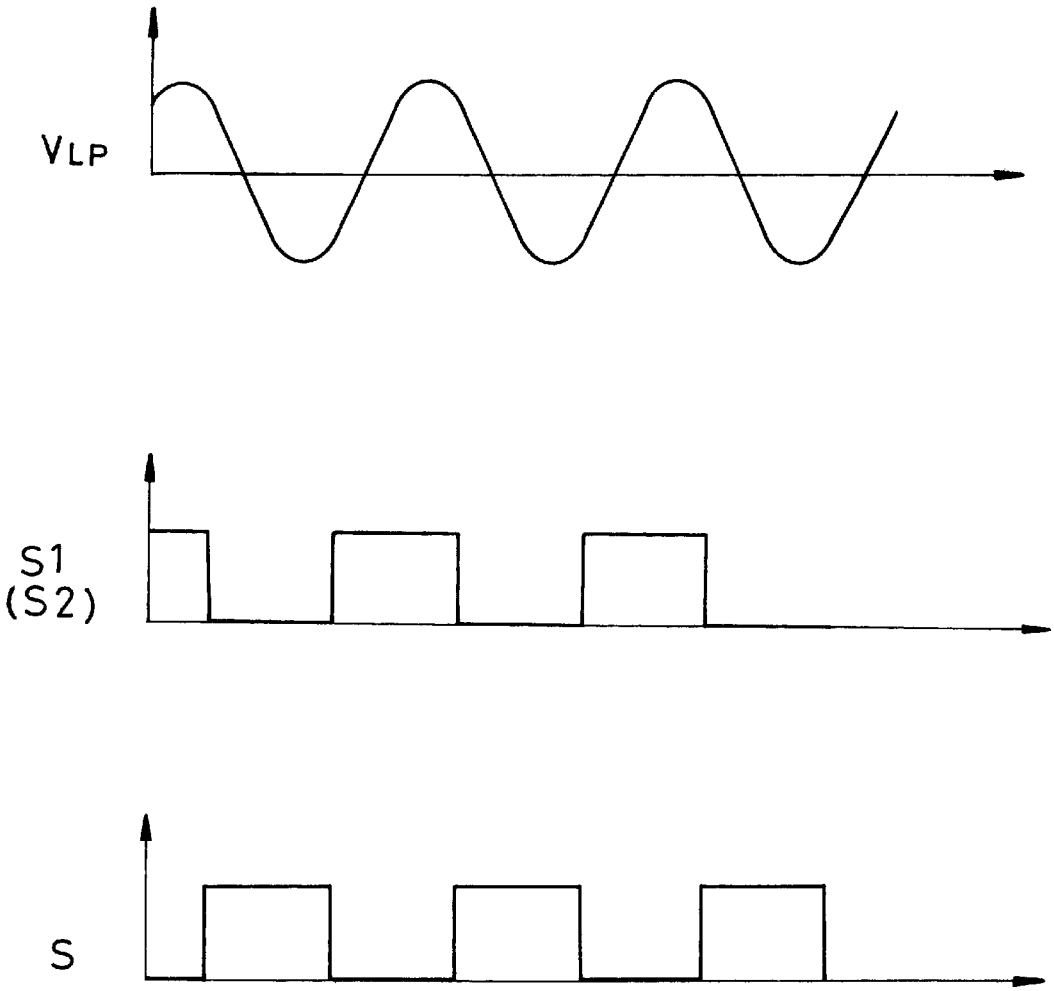

A preferred embodiment of a multi-lamp protection circuit for an electronic ballast in the present invention, as shown in FIGS. 1 and 2, includes a rectifying and filtering circuit 10, a DC-AC inverter circuit 20, a control-signal generating circuit 30, lamp circuits 41 and 42, abnormality-detect circuit 51 and 52, and AND gates 61 and 62. If a plurality of lamp circuits is required, the number of lamp circuits, abnormality-detect circuit, and AND gates can be increased.

The inverter circuit 20 which is DC energized by the rectifier circuit 10, consists of a common switch S, four diodes D1, D2, D3 and D4, and switches S1, S2. Where S joined with S1, S joined with S2 make up two half-bridge inverters. The switches are gated by the separately-excited control circuit 30.

The first lamp circuit 41 is connected to the ends of the common switch S and the diode D3. The second lamp circuit 42 is parallel-connected to S and D4. If more than two lamps circuits are required, the additional lamp circuits are parallel-connected.

A signal taken from lamp circuits 41, 42, is sent through the switches S1 and S2 respectively to resistors R1 and R2 to generate voltage signals. The voltage signals will serve as the gate signals of thyristors SCR1 and SCR2. The anodes of SCR1 and SCR2 are connected to a DC-bias and compared by comparators OP1 and OP2 with a reference voltage Vref, generating an output signal. The output signal together with the square wave driving signals triggered by control circuits 30 are logically AND gated by gates 61 and 62. The signals are then fed back to driving S1 and S2 for cutting off an abnormal lamp circuit(s) immediately.

The main principle of this multi-lamp protection circuit for an electronic ballast is that the control signals for switches S1, S2 are in-phase, that for switch S is out-phase. Take lamp Lp1 as an example to illustrate the operation of this circuit. When Lp1 operates normally, the lamp voltage is a sine wave because of the alternately switching of switches S and S1 together with the series resonant circuit Cs1 and Ls1. At first, switch S OFF and S1 ON, current flows from lamp Lp1, capacitor Cs1, inductor Ls1, switch S1, and resistor R1, then returns to ground. When the resonant voltage gradually declines to zero, switch S1 turns off and current flows directly from diode D1 back to Lp1, with the common switch S turning ON.

When the lamp voltage is in negative half cycle, with switch S ON, and S1 OFF, current flows reversely from Ls1, Cs1 to Lp1. When Lp1 has its voltage recovering from negative half to zero crossing, S1 turns ON, current flows back to the lamp Lp1 through the capacitor Cdc, resistor R1, S1, Ls1, and Cs1. Switches S and S1 will turn on under zero-voltage-transition, therefore the circuit efficiency can be promoted and causing smaller voltage stress on the switches.

Provided that lamp Lp1 should become damaged, voltage across resistor R1 rises up, and the thyristor SCR1 is turned ON, forcing the comparator OP1 giving a low output. After the AND gate 61, the gate control signal is kept at low, therefore operation of switch S1 is suppressed. The resonant inverter circuit of Lp1 is dismounted because of the absence of S1, lamp Lp1 ceases. However, at the same time, switch S2 still operates normally as the operation of gate 62 remains unaffected. If the lamp Lp2 should become damaged, the scenario will be the same as the case of lamp Lp1.

The output of abnormality detect circuit adopted in this invention is low whenever any abnormality occurred. If applied in other circuit, and that of abnormality detect circuit is high, only an additional NOT gate is required at the input terminal of AND gate. This invention needs only one signal control unit to control the two switches in the half bridge inverter. In addition, the upper arm only claims a common switch, one for a single lamp respectively. Consequently, compared to the number of lamps, that of switches is only one more. Although the common switch S might flow a comparatively larger current, control circuits and other necessary components can be saved conspicuously. Above all, to prolong service life of lamps, preheating of lamp is usually essential at the cost of additional control IC required. Consequently, upon the application of multi-lamps, the component saving by using this invention is very remarkable.

To sum up, this invention makes use of a single controller controlling various types of current inverters (such as of half-bridge, quasi-half bridge, full-bridge, push-pull, buck, boost, buck-boost, fly-back, or hybrid type) in driving multi-lamps at the same time. In addition, the switches are turned on at zero voltage to lessen switching loss and stress of the components and thus enhance the efficiency of whole ballast circuit. Furthermore, provided any individual lamp is investigated as damaged, the control circuit is capable of cutting off the spoiled lamp immediately, without any impact to other normal lamps. Thus the invention not only achieves protection function for multi-lamps, but largely lessens its producing cost.

While the preferred embodiment of the invention has been described above, it will be recognized and understood that various modifications may be made therein and the appended claims are intended to cover all such modifications that may fall within the spirit and scope of the invention.

What is claimed is:

1. A multi-lamp protection circuit for an electronic ballast comprising:

a rectifying and filtering circuit;

an inverter circuit;

a plurality of lamp circuits;

a plurality of abnormality detect circuits; and, characterized by every said lamp circuit connected to said inverter circuit, a current or voltage signal taken out of every said lamp circuit and sent to relative said abnormality detect circuit, a control signal and calculation by a plurality of AND gates controlling operation of a plurality of switches of said inverter circuit and indirectly checking out abnormal disorder signal of a lamps, then said lamp circuit(s) automatically cut off, and a control circuit needs only one gate signal control unit for controlling switches of an upper arm and lower arm(s) of half-bridge inverter(s), and the gate signals of upper and lower arms are out-phase.

2. The multi-lamp protection circuit for an electronic ballast as claimed in claim 1, wherein every said lamp circuit is connected to the same switch of said inverter circuit to save the cost.

3. The multi-lamp protection circuit for an electronic ballast as claimed in claim 1, wherein said abnormality detect circuit uses a comparator or other output signal for controlling said AND gates, and the input of said AND gates is connected to a NOT gate if the output of the abnormality detect circuit is high.

4. The multi-lamp protection circuit for an electronic ballast as claimed in claim 1, wherein said inverter circuit is a half-bridge circuit.

5. The multi-lamp protection circuit for an electronic ballast as claimed in claim 1, wherein said inverter circuit is a quasi-half-bridge circuit.

6. The multi-lamp protection circuit for an electronic ballast as claimed in claim 1, wherein said inverter circuit is a full-bridge circuit.

7. The multi-lamp protection circuit for an electronic ballast as claimed in claim 1, wherein said inverter circuit is a push-pull circuit.

8. The multi-lamp protection circuit for an electronic ballast as claimed in claim 1, wherein said inverter circuit is a buck circuit.

9. The multi-lamp protection circuit for an electronic ballast as claimed in claim 1, wherein said inverter circuit is a boost circuit.

10. The multi-lamp protection circuit for an electronic ballast as claimed in claim 1, wherein said inverter circuit is a buck-boost circuit.

11. The multi-lamp protection circuit for an electronic ballast as claimed in claim 1, wherein said inverter circuit is a fly-back circuit.

12. The multi-lamp protection circuit for an electronic ballast as claimed in claim 1, wherein said control circuit is a self-excited type.

13. The multi-lamp protection circuit for an electronic ballast as claimed in claim 1, wherein said control circuit is a separately-excited type.

* * * * *